United States Patent [19]

Wallner

[11] 4,072,385

[45] Feb. 7, 1978

[54] BAYONET CONNECTION BETWEEN TWO ELECTRICALLY CONDUCTIVE COMPONENTS

[75] Inventor: Peter Wallner, Kriens, Switzerland

[73] Assignee: Schurter AG, Luzern, Switzerland

[21] Appl. No.: 731,559

[22] Filed: Oct. 12, 1976

[30] Foreign Application Priority Data

Oct. 21, 1975 Switzerland ..... 13594/75

[51] Int. Cl.[2] ..... H01H 85/16; H01R 13/54

[52] U.S. Cl. ..... 339/88 R; 337/236; 339/90 F; 339/188 R

[58] Field of Search ..... 339/88 R, 90 C, 90 F, 339/93 L, 117 R, 150 F, 181 R, 181 C, 187, 188 R, 210 R, 253 R, 255 R, 273 S, 252 F, 253 F; 337/227, 231, 239, 236, 238

[56] References Cited

U.S. PATENT DOCUMENTS

| | | | |
|---|---|---|---|
| 1,514,314 | 11/1929 | Douglas | 339/188 R |
| 3,477,062 | 11/1969 | Wagstaffe | 339/88 R |

*Primary Examiner*—Roy Lake
*Assistant Examiner*—E. F. Desmond
*Attorney, Agent, or Firm*—Werner W. Kleeman

[57] ABSTRACT

A bayonet connection between two electrically conductive components, especially for fuse holders, wherein at least one connection component possesses an electrically conductive spring which is electrically conductively connected with the one connection component. This spring, when there is established a connection between the connection components, electrically conductively contacts the second connection component.

15 Claims, 11 Drawing Figures

BAYONET CONNECTION BETWEEN TWO ELECTRICALLY CONDUCTIVE COMPONENTS

BACKGROUND OF THE INVENTION

The present invention relates to a new and improved construction of bayonet connection between two electrically conductive components, especially for a fuse holder.

Conventional fuse holders possess a socket and a head detachable from the socket. The fuse element or cartridge partially is inserted in the head and at that location contacts a connection line or conductor and is pressed by means of a spring against the base contact of the socket, whereas the end of the fuse element at the side of the head is connected via a connection line or conductor with a side contact of the socket. Due to the spring effective between the fuse element and the head, and which urges the fuse element against the base contact of the socket, the head is pre-biased to a certain extent towards the outside. Now if a force is applied to the head then the latter approaches the fuse element, with the result that such penetrates deeper into the socket. The conventional bayonet connections, serving for connecting the connection line at the side of the head and the side or lateral contact at the side of the socket, only then afford a reliable electrical connection when the head is retained by the spring in its outermost position. Upon penetration of the head into the socket the mutually contacting components of the bayonet connection are raised from one another, so that some of these type fuse holders can be considered to constitute key switches, in other words pulse switches. This behavior is not only present upon contact of the head, rather also is conceivable during jarring or vibrations. Nonetheless, a bayonet connection between the connection conductor and the side contact affords considerable advantages in relation to other types of connections. A friction closure, which of course is not capable of retaining the head in the socket, must be secured by the provision of an additional closure between the head and the socket, whether such be accomplished by threading or by a bayonet connection. This not only is associated with a considerably greater expenditure, but furthermore, also presupposes the possibility of appropriately increasing the dimensions of the fuse holder, something which is hardly possible when miniaturization and micro-miniaturization is desired. Moreover, friction closures, as is known, also have additional drawbacks. A direct threaded connection between the side or lateral contact and the connection conductor is problematic, especially when the fuse holder possesses small dimensions, and as to the manufacture thereof of course is not as advantageous as is the case with bayonet closures or connections. Additionally, such type of threaded closure has the inherent drawback that it does not constitute a quick-release or operating closure. Further drawbacks of screw or thread connections are well known in the art.

SUMMARY OF THE INVENTION

Hence, it is a primary object of the present invention to provide a new and improved construction of bayonet connection between two electrically conductive components which is not associated with the aforementioned drawbacks and limitations of the prior art proposals.

Another and more specific object of the present invention aims at providing a new and improved construction of a bayonet lock or connection between electrically conductive components, especially suitable for a fuse holder, but also for other electrical components, and which does not possess the drawbacks of the heretofore known bayonet connections as have been discussed above.

Now in order to implement these and still further objects of the invention, which will become more readily apparent as the description proceeds, the invention contemplates providing a bayonet connection or lock between electrically conductive components, especially for a fuse holder, which according to the invention is manifested by the features that at least one connection component possesses an electrically conductive spring which is electrically conductively connected with said one connection component, and this spring, when there is established a connection between the connection components, electrically conductively contacts the second connection component.

Now if with a fuse holder force is applied to the head in the previously mentioned manner, then, while the mutually contacting connection components would be raised from one another owing to the spring acting between the head and the fuse insert, however the contact between the spring of the one connection component and the other connection component would be maintained, even in fact increased owing to deformation of the spring, so that there would not be present any wobble contact in the manner of a key switch.

The inventive bayonet connection is advantageously equipped with a spring which is contacted in the joint direction, i.e. in the axial direction of the components, As a result, it can be formed of one-piece with the corresponding connection component in an especially simple manner. However, it is also possible to attach such type spring or a different kind of spring at the relevant connection component, for instance by rivets or welding, which however is less preferred. The main advantage of the one-piece fabrication is then realized if the relevant bayonet connection component is stamped from a sheet metal piece and, for instance, subsequently bent into a substantially cylindrical jacket or shell for the side contact of the fuse holder. It is then possible to stamp the aforesaid from the same sheet metal piece, and specifically, in such a manner that it penetrates into the mouth of the hook-like parts of the relevant connection component, into which then there engages the counterpiece of the other connection component during joining and rotation. The spring can then advantageously extend primarily in the peripheral direction of the cylindrical jacket-like component or part, so that upon rotation of the bayonet connection it is not particularly markedly deformed. With such construction it also does not have any steep shoulders, which likewise is necessary to achieve rotation of the connection components with low friction.

A preferred embodiment of bayonet connection is manifested by the features that the connection components are constructed at the ends of at least approximately equal diameter cylindrical jacket or shell portions in the form of hook-like parts which are oppositely directed and extend in the peripheral direction. At least one hook-like part is associated with the spring. This construction allows the diameter of the connection to be maintained particularly small, because it does not require any parts which successively follow one another in radial direction.

According to another preferred construction of bayonet connection the one connection component can be bent in a substantially cylindrical jacket-like manner and is provided at its one end with at least one hook-like part into which engages the second connection component with a locking or engaging pin or by means of a tab or flap flexed therefrom. This bayonet-like connection is, for instance, also suitable for use with lamp sockets. Advantageously, the connection component equipped with the hook-like parts is also equipped with the spring. Also in this case the spring is advantageously arranged such that it extends in the form of an elongate structure into the mouth of the hook-like part, this elongate structure extending primarily in the peripheral direction. The spacing between this spring and the hook-like part, by definition, should not be smaller than the diameter of the locking pin or the thickness of the flexed tab or flap respectively, because the spring must engage the locking pin and flap, as the case may be, in the locked condition.

From what has been discussed above it is of course possible to carry out modifications if the spring is differently arranged, in other words should not contact, in the mouth of the hook-like part, the there located part of the other connection component, rather if such is constructed in a manner that it contacts the other connection component at some other location. Such different type of spring, for instance an axially extending spring can be associated with a number of difficulties, especially during the micro-miniaturization, because the length of the spring of course should not exceed a certain size if it should not be too hard or if its spring path should not be too short.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
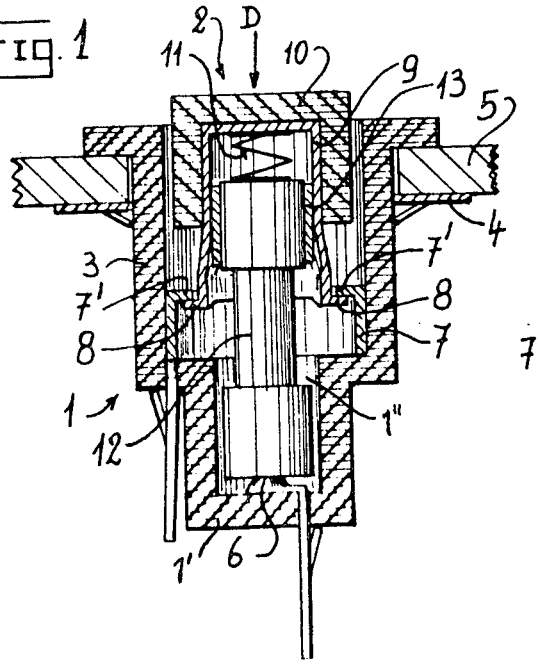
FIG. 1 is a schematic longitudinal sectional view of a conventional fuse holder.

Describing now the drawings, the fuse holder shown in FIG. 1, exemplifying the prior art, will be seen to comprise a socket 1 and a head or head member 2 inserted therein. The socket housing 3 consists of insulating material and is secured by means of a spring disk 4 at a plate 5, which for instance can be part of the apparatus housing or a switching panel. At the base or floor 1' of the socket opening 1'' there is arranged the base contact 6 whereas somewhat above the socket base 1' there is mounted in the socket opening 1'' the side or lateral contact 7. This side contact 7 possesses two inwardly flexed flaps or tabs 7' which, in the illustrated locked position of the head 2, are connected in a bayonet-locking manner with the counter-flaps 8 of the connection conductor 9 of the head 2. The connection conductor 9 is a substantially bell-shaped structure which is fixedly inserted in the insulated part 10 of the head 2. Internally of the connection conductor 9 there is arranged a spring 11 acting upon the end of the fuse element or cartridge 12 inserted into the head or head member 2 and such spring presses the fuse element 12 with its base-end snugly against the base contact 6.

Figure 2:
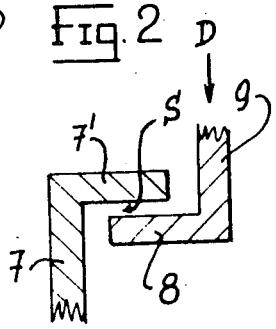
FIG. 2 illustrates an enlarged detailed showing of part of the bayonet connection of the arrangement of FIG. 1.

A contact ring 13 welded to the connection conductor 9 ensures for a good electrical connection between the end of the fuse insert or cartridge 12 located at the region of the head 2 and the connection conductor 9. In the position shown in FIG. 1 the fuse insert 12 therefore is positively connected with the side contact 7 and the base contact 6. Yet, these conditions change as soon as even only slight pressure is exerted against the head or head member 2 in the direction of the arrow D. As soon as the head 2 moves into the socket 1, then, as shown particularly well in FIG. 2, the flaps or tabs 7' and 8' of the side contact 7 and the connection conductor 9, respectively, are spaced from one another in the manner indicated in FIG. 2, so that there is formed a gap S, resulting in interruption of current flow. Consequently, there is present the previously mentioned key-like function of the fuse holder.

The construction of bayonet closure as shown in FIG. 1 has only been selected because this type of bayonet closure or connection demonstrates extremely well the afore-discussed loose contact. On the other hand, there will be considered hereinafter with regard to FIGS. 3–9 connections or closures which are of advantageous practical significance and, especially, the diameter of which can be made smaller.

Figure 3:
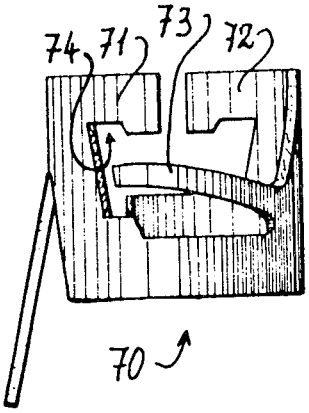
FIG. 3 illustrates a bayonet closure-connection component of a bayonet connection or closure of the invention and used as a side or lateral contact of a fuse holder.
Figure 4:
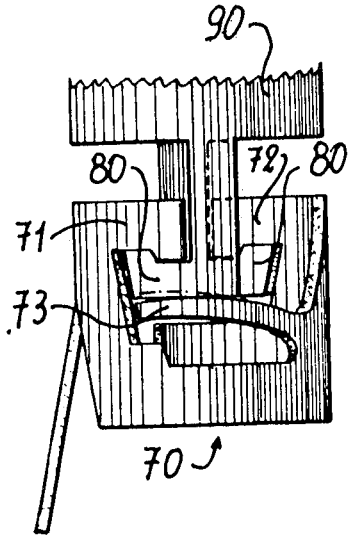
FIG. 4 illustrates a bayonet closure of the invention with the component shown in FIG. 3.
Figure 5:
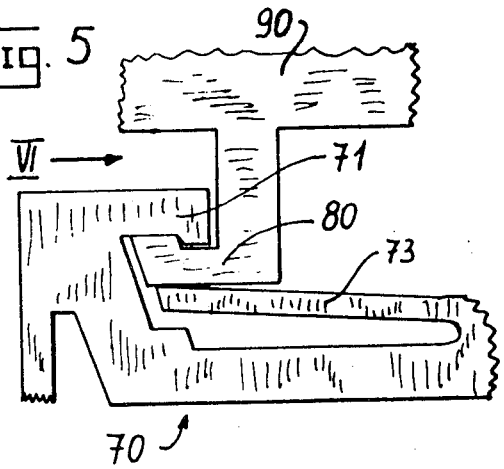
FIG. 5 illustrates a flat wound portion of the bayonet closure or connection on an enlarged scale relative to the showing of FIG. 4.
Figure 6:
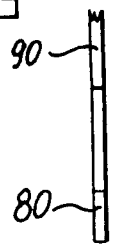
FIG. 6 is a view of the upper bayonet closure component looking in the direction of the arrow VI of FIG. 5.

The bayonet closure illustrated in FIGS. 3–5 is conceived as a connection for a side contact and a connection conductor. The side contact or component 70 is constructed essentially as a cylindrical jacket-like structure, as best seen by referring to FIG. 3, and at its end possesses two substantially hook-like portions 71 and 72 of practically the same construction. Additionally, there is provided a spring 73 which is stamped from the same sheet metal piece, this spring 73 extending into the mouth 74 of the hook-like part 71. As best recognized by referring to FIG. 4 the counter-element of the part 70, and which here constitutes the connection conductor, is designated by reference character 90 and will be seen to possess two similar hook-shaped parts 80 which engage with the hook-like parts 71 and 72 of the component 70. The front hook-like part 80 of the showing of FIG. 4, when in its engaged position, contacts the spring 73 which is thus downwardly deflected out of the phantom line rest position.

Figure 7:
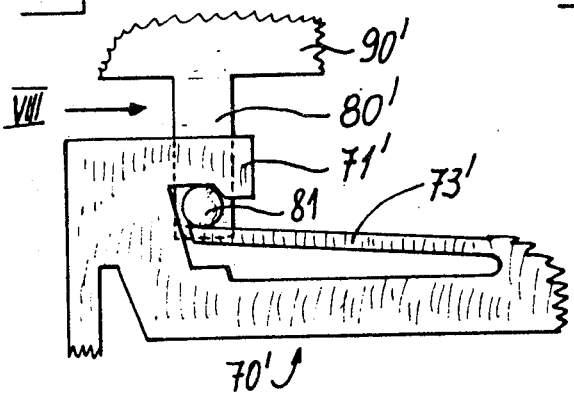
FIG. 7 is a similar view to that of FIG. 5 of a different exemplary embodiment of a bayonet closure piece.
Figure 8:
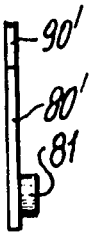
FIG. 8 is a view of the upper bayonet closure component looking in the direction of the arrow VIII of FIG. 7.

The comments which have just been made with regard to the embodiment of FIG. 4 are equally applicable to the embodiment of FIG. 5. These comments also are useful in understanding the embodiments of FIG. 7-9. In FIG. 7 there will be recognized the component 70′ which is extremely similar to the component 70 of FIG. 5. The component 70′ possesses a hook-shaped portion 71′ and a spring 73′. Instead of the component 90 of FIG. 5 there could be used, in this case, the component 90′ which similarly constitutes a connection conductor, wherein, however, in place of the hook-like component 80 of FIG. 5 there is here provided a straight flap or tab 80′ having a locking or engaging pin 81. The parts 80′, 90′ and 81 have been shown with greater clarity in FIG. 8.

Figure 9:
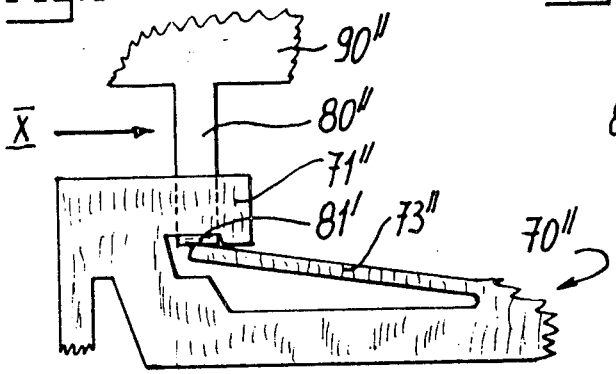
FIG. 9 is an illustration, similar to the showing of FIGS. 5 and 7, of a third embodiment of a bayonet closure piece.
Figure 10:
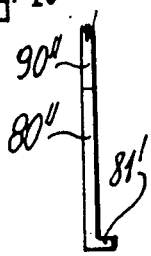
FIG. 10 is a view of the upper bayonet closure portion looking in the direction of the arrow X of FIG. 9.

Also the component 70″ of FIG. 9 is quite similar to the component 70 of FIG. 5 and will be seen to possess a substantially hook-like portion 71″ as well as a spring 73″. The component 90″, as best seen by also referring to FIG. 10, again is conceived as a connection conductor, and it has a flap or tab 80″ similar to the flap 80″ of FIGS. 7 and 8, but instead of the locking pin 81 of FIGS. 7 and 8, here there is provided a flexed or angled portion 81″ of the flap 80″.

In contrast to the showing of FIG. 5, the exemplary embodiments of FIGS. 7 and 9 have the apparent drawback that the parts 71′, 80′ and 71″, 80″, respectively, come to bear above one another in radial direction, i.e. in this case perpendicular to the plane of the drawing, so that when used in a fuse holder there is required a greater diameter than for the construction of FIG. 5. On the other hand, the exemplary embodiments of FIGS. 7 and 9 are, for instance, especially suitable for use as lamp fixtures, and the components 90′ and 90″, respectively, can be considered to constitute lamp sockets.

Figure 11:
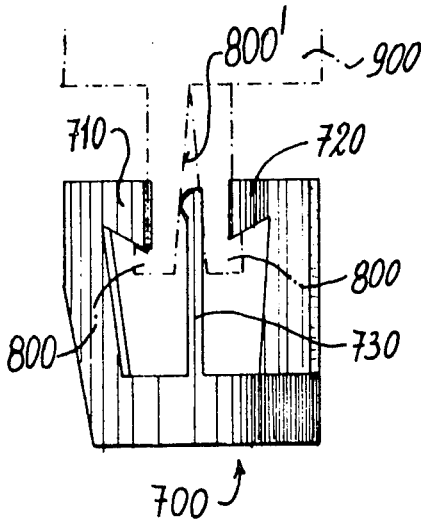
FIG. 11 is an illustration, similar to the showing of FIG. 4, of another embodiment of bayonet connection or closure constructed according to the invention.

The bayonet connection or closure illustrated in FIG. 11 possesses a side contact portion 700 with end hooks 710 and 720. Arranged forwardly of the hook 710 is an axial spring 730 which resiliently bears against the inclined shoulder 800′ of the hook 800 of the connection conductor 900. Since the spring 730 must have a certain minimum length, there is needed a larger structural length than with the embodiment of FIGS. 3 and 4. Of course, the embodiment of FIG. 11 could also be constructed as a variant construction like those of FIGS. 5-10.

While there are shown and described present preferred embodiments of the invention, it is to be distinctly understood that the invention is not limited thereto, but may be otherwise variously embodied and practiced within the scope of the following claims.

Accordingly, what is claimed is:

1. A bayonet connection between two electrically conductive components, especially for a fuse holder, comprising a pair of connection components, one of the connection components possessing an electrically conductive spring, said spring being electrically conductively connected with said one connection component, said one connection component has at least one hook-like part provided with a mouth, and said spring comprises an elongate component primarily extending in the peripheral direction and protruding into said mouth of said hook-like part, said spring, when the two connection components are operatively interconnected, electrically conductively contacting the other connection component and uring said other connection component towards said hook-like part.

2. The bayonet connection as defined in claim 1, wherein the spring is formed of one-piece with said one connection component.

3. The bayonet connection as defined in claim 1, wherein the one connection component possesses a flexed substantially cylindrical jacket and is provided at an end thereof with at least one substantially hook-like part, the other connection component having a locking pin engaging in said hook-like part.

4. The bayonet connection as defined in claim 1, wherein each of said two connection components comprises an at least approximately equal diameter cylindrical jacket portion at an end of which there are provided oppositely directed substantially hook-shaped parts extending in the peripheral direction, at least one of the hook-shaped parts having associated therewith said spring.

5. The bayonet connection as defined in claim 1, wherein said one connection component is flexed as a substantially cylindrical jacket and is provided at one end with at least one substantially hook-like part, the other connection component having a flexed flap member engaging with said hook-like part.

6. A bayonet connection between two electrically conductive components, especially for a fuse holder, comprising a pair of connection components, one of the connection components possessing an electrically conductive spring, said spring being electrically conductively connected with said one connection component, said spring, when the two connection components are operatively interconnected, electrically conductively contacting the other connection component, each of said two connection components comprises an at least approximately equal diameter cylindrical jacket portion at an end of which there are provided oppositely directed substantially hook-shaped parts extending in the peripheral direction, at least one of the hook-shaped parts having associated therewith said spring.

7. The bayonet connection as defined in claim 6, wherein said at least one hook-like part has a mouth, and said spring comprises an elongate component primarily extending in the peripheral direction and protruding into said mouth of said hook-like part.

8. A bayonet connection between two electrically conductive components, especially for a fuse holder, comprising a pair of connection components, one of the connection components possessing an electrically conductive spring, said spring being electrically conductively connected with said one connection component, said spring, when the two connection components are operatively interconnected, electrically conductively contacting the other connection component, said one connection component possesses a flexed substantially cylindrical jacket and is provided at an end thereof with at least one substantially hook-like part, the other connection component having a locking pin engaging in said hook-like part, the hook-like part has a mouth, and said spring is constructed as an elongate part extending primarily in the peripheral direction and protruding into said mouth of said hook-like part.

9. A bayonet connection between two electrically conductive components, especially for a fuse holder, comprising a pair of connection components, one of the connection components possessing an electrically conductive spring, said spring being electrically conductively connected with said one connection component, said spring, when the two connection components are operatively interconnected, electrically conductively contacting the other connection component, said one connection component is flexed as a substantially cylindrical jacket and is provided at one end with at least one substantially hook-like part, the other connection component having a flexed flap member engaging with said hook-like part.

10. The bayonet connection as defined in claim 9, wherein the hook-like part has a mouth, and the spring is constructed as an elongate part extending primarily in the peripheral direction and protruding into the mouth of said hook-like part.

11. A bayonet connection between two electrically conductive components, especially for a fuse holder, comprising a pair of connection components, one of the connection components possessing an electrically conductive spring, said spring being electrically conductively connected with said one connection component, said one connection component has at least one hook-like part provided with a mouth, and said spring comprises an elongate component primarily extending in the axial direction and in front of said mouth of said hook-like part, said spring, when the two connection components are operatively interconnected, electrically conductively contacting the other connection component and urging said other connection component towards said hook-like part.

12. The bayonet connection as defined in claim 11, wherein the spring is formed of one-piece with said connection component.

13. The bayonet connection as defined in claim 11, wherein each of said two connection components comprises an at least approximately equal diameter cylindrical jacket portion at an end of which there are provided oppositely directed substantially hook-shaped parts extending in the peripheral direction, at least one of the hook-shaped parts having associated therewith said spring.

14. The bayonet connection as defined in claim 11, wherein the one connection component possesses a flexed substantially cylindrical jacket and is provided at an end thereof with at least one substantially hook-like part, the other connection component having a locking pin engaging in said hook-like part.

15. The bayonet connection as defined in claim 11, wherein said one connection component is flexed as a substantially cylindrical jacket and is provided at one end with at least one substantially hook-like part, the other connection component having a flexed flap member engaging with said hook-like part.

* * * * *